US005410900A

United States Patent [19]

Mattingly

[11] Patent Number: 5,410,900

[45] Date of Patent: May 2, 1995

[54] SECURITY LOCK ASSEMBLY

[76] Inventor: William E. Mattingly, 1731 Thames Dr., Clarksville, Ind. 47129

[21] Appl. No.: 57,749

[22] Filed: May 4, 1993

[51] Int. Cl.[6] ..... E05B 39/04

[52] U.S. Cl. ..... 70/436; 70/462; 292/139; 292/244

[58] Field of Search ..... 70/432–437, 70/461, 462; 292/139, DIG. 17, 244

[56] References Cited

U.S. PATENT DOCUMENTS

| | | | |
|---|---|---|---|
| 827,177 | 7/1906 | Pixley . | |
| 1,394,475 | 10/1921 | Crosby | 70/436 |
| 1,465,136 | 8/1923 | Klein . | |
| 1,590,046 | 6/1926 | Man et al. . | |
| 1,699,190 | 1/1929 | Hoffmann . | |
| 3,389,932 | 6/1968 | Pastya, Jr. | 292/173 |
| 4,263,795 | 4/1981 | Van Gompel | 292/36 X |
| 4,468,943 | 9/1984 | Beattie et al. | 292/36 X |
| 4,823,510 | 4/1989 | Amos | 292/DIG. 17 X |
| 5,006,697 | 4/1991 | Amis et al. | 235/91 R |
| 5,047,748 | 9/1991 | Trickle | 70/432 X |
| 5,063,764 | 11/1991 | Amis et al. | 70/436 X |

*Primary Examiner*—Lloyd A. Gall
*Attorney, Agent, or Firm*—Polster, Lieder, Woodruff & Lucchesi

[57] ABSTRACT

A security lock assembly for mounting on a door to cooperate with at least one slot associated with either door frame side comprising a mountable and adjustable unit structural assembly including a pivotable handle, reversible locking bar structure alignable and cooperable with either door frame side associated slot, a counter register, and mechanical linkage structure connecting the pivotal handle with the locking structure and with the counter register.

15 Claims, 3 Drawing Sheets

SECURITY LOCK ASSEMBLY

BACKGROUND OF THE INVENTION

The present invention relates to a unique lock assembly and more particularly to a unique and novel security lock assembly for quickly and securely fastening a door to a door frame and for registering each opening of the security lock.

Various mechanisms for securely locking a door with a dead lock bolt and registering the locking with a counter mechanism associated with movement of the dead bolt have long been known in the art. In this regard, attention is directed to the long expired U.S. Pat. No. 827,177, issued to J. F. Pixley on Jul. 31, 1906, which discloses a rotatable and movable bolt mountable on a door to slidably engage with a keeper when rotated and moved longitudinally by a hand operated bolt knob, the bolt engaging with a finger of a registering mechanism. Further attention is directed to the long expired U.S. Pat. No. 1,590,046, issued to E. 0. Man et al on Jun. 22, 1926, which teaches a more complex arrangement, including a seal associated with a lock element with means adapted to be moved by the lock element during seal application to effect actuation of a registering mechanism. In addition, attention further is directed to the comparatively complex strap, hook and counter mechanism disclosed in U.S. Pat. No. 1,465,136, issued to A. Klein on Aug. 14, 1923. Attention also is directed to the comparatively complex lock and counter mechanisms disclosed in U.S. Pat. Nos. 1,699,190, issued to A. Hoffman on Jan. 15, 1924; No. 3,389,932 issued to J. V. Pastra, Jr. on Jun. 25, 1968 and No. 5,006,697, issued to Lynn F. Amis on Apr. 9, 1991. Although each of these aforementioned mechanisms teaches the broad concept of a lock and associated counter mechanism in a comparatively complex structural arrangement, none teaches the unique security lock assembly structure of the present invention which is straightforward and economical to manufacture, assemble and maintain so as to allow an easily and readily operable quick exit in the event of an emergency. At the same time, the unique security lock assembly of the present invention, provides a registered counter mechanism and log sheet associated therewith as an aid in determining unauthorized usage of such lock assembly. Further, the unique structural assembly of the present invention allows for quick and easy unit installation for doors of various sizes and usages, including both right and left hand operated doors. In addition, the structure of the present invention allows for force adjustment of the actuating mechanism, and provides for cover protection of a portion of the security lock, adjusting force mechanism and counter mechanism upon installation, further allowing for the locking of the lock assembly actuating mechanism after covering when the same is not in use.

Various other features of the present invention will become obvious to one skilled in the art upon reading the disclosure set forth herein.

BRIEF SUMMARY OF THE INVENTION

More particularly, the present invention provides a security lock assembly for mounting on a door to cooperate with at least one slot associated with a door frame side for the door comprising: a pivotal handle means adapted to be pivotally mounted on a face of the door; reversible locking bar means adapted and sized to be movably mounted on the door face in aligned locking and unlocking relation with a preselected slot associated with either door frame side; mechanical linkage means adapted to accommodate the reversible locking bar means to be mounted to the door face to connect the pivotally mounted handle means and the locking bar means whereby pivotal movement of the handle means actuates the mechanical linkage means to cause the locking means to engage and disengage in locking and unlocking relation with the slot associated with the selected door frame side; and, counter means cooperatively activated with the locking means movement to register the locking-unlocking, engagement-disengagement with the door frame side associated slot. In addition, the present invention provides: a unique structural locking arrangement to prevent an opening access by door hinge removal; a readily, visibly and easily operable actuating mechanism; a unique cover protected reversible, unit assembly; a unique actuating force adjustment; and, a unique locking arrangement for the security lock assembly when not in usage.

It is to be understood that various changes can be made by one skilled in the art in one or more of the several parts of the structure disclosed herein without departing from the scope or spirit of the present invention. For example, the pivotal actuating mechanism could be positioned vertically as well as horizontally, the universal-like cam mechanism could be of different size and contour, as could the locking bar and slots, as well as, their respective locations. Further, the inventive unitary security lock assembly disclosed herein could be utilized with other covered openings besides door openings, such as with escape hatches in homes, auditoriums and vehicles.

BRIEF DESCRIPTION OF THE DRAWINGS

Referring to the drawings which disclose one advantageous embodiment of the present invention.

DETAILED DESCRIPTION OF THE DRAWINGS

Figure 1:
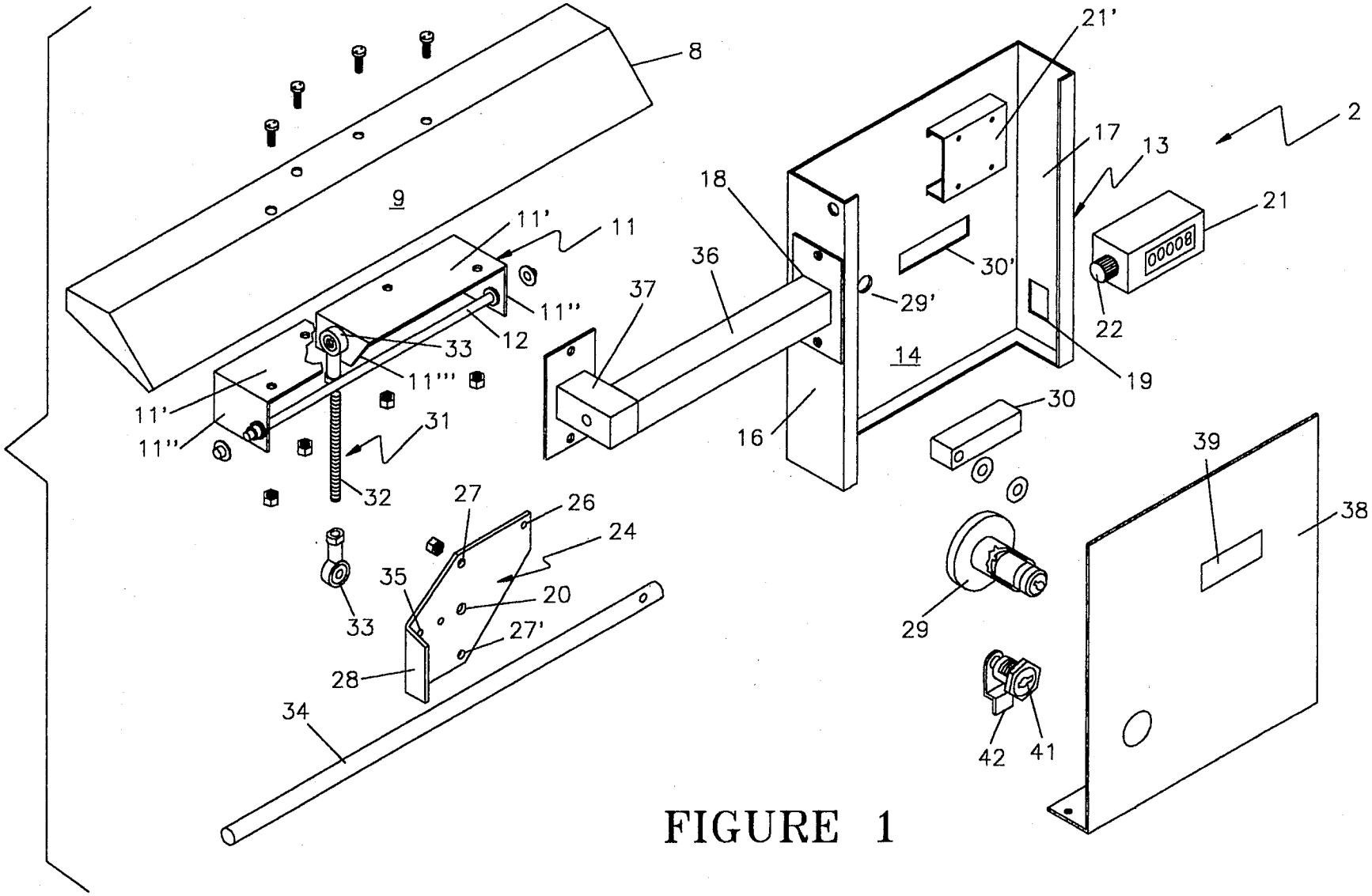
FIG. 1 is an exploded, partially broken away, isometric view of the principal parts of the security lock assembly of the present invention with the spring loaded ball bearing cylinder element enlarged and broken away.
Figures 2, 3:
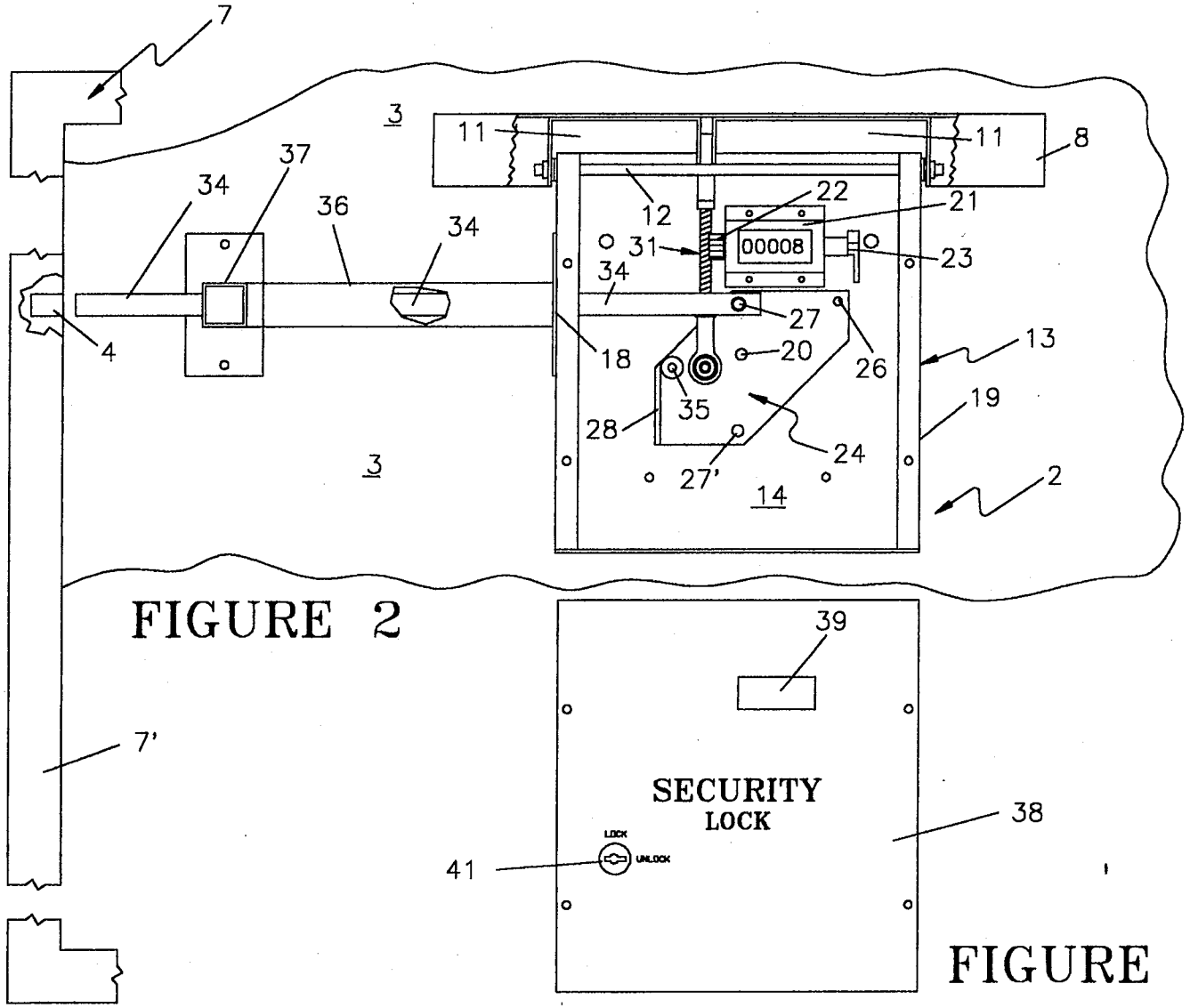
FIG. 2 is a partially broken away, front view of a portion of the parts of FIG. 1, shown in assembled relation in mounted position on a portion of the face of a hinged door to be secured, only a portion of such inner face of the door and door frame being disclosed.
FIG. 3 is a front view of the cover plate for the housing of FIG. 2.
Figure 4:
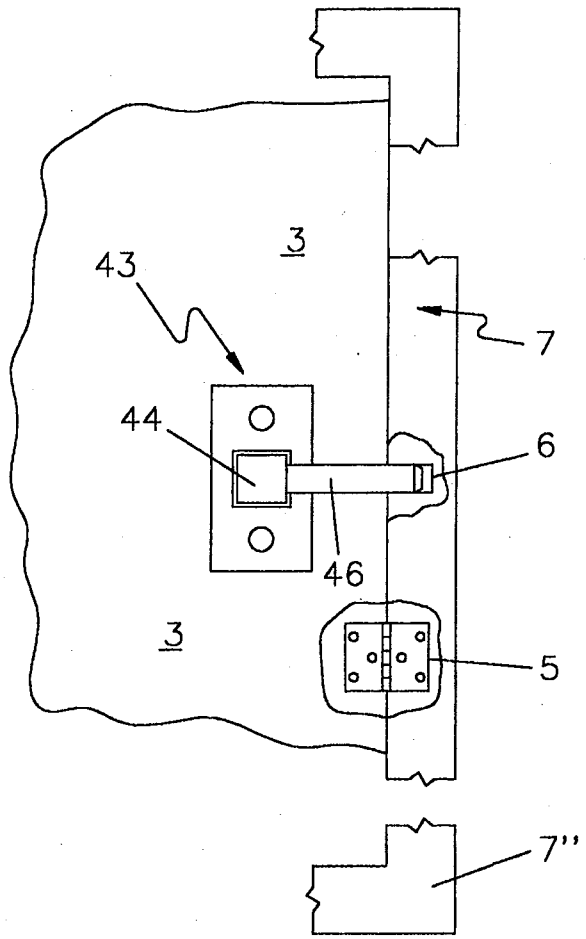
FIG. 4 is a schematic, partially broken away, front view of a locking bar in mounted position on a portion of the same face of the hinged door to cooperate with a second slot in the door frame adjacent the hinged side of the door; and, FIG. 5 is a portion of an inventive log memorandum to be associated with the security lock assembly described herein.

As can be seen in FIG. 1, 2 and 4 of the drawings, a security lock assembly 2 for mounting on the inner face of a hinged door 3 is disclosed. This assembly cooperates with a pair of slots 4 and 6 respectively preselectively disposed in opposite sides 7' (FIG. 2) and 7'' (FIG. 4) of door frame 7 with one of the pair, namely 6 (FIG. 4), being preselectively disposed in door frame 7 adjacent the hinged side of door 3 and the other slot 4 of the pair being located in door frame 7 intermediate the opposite side thereof. Suitable locking bars comprising a portion of the inventive assembly are described hereinafter.

As can be seen clearly in exploded FIG. 1 of the drawings, the novel security lock assembly 2, which can principally be formed from suitable metallic materials, includes a longitudinally extending handle 8. In accordance with one feature of the present invention, it is to be noted that handle 8 is of preselected cross-sectional configuration to provide a longitudinally extending legend carrying face 9 for the printing of an appropriate notice which can be readily read by a handle operating party.

Again referring to FIG. 1, handle 8 can be mounted by suitable screws and bolts to the base legs 11' of a pair of spaced, side-by-side U-shaped bracket members 11. The extremities of the outer side legs 11'' of these bracket members 11 are fastened to the ends of a bar 12 rotatably and pivotably mounted to the side walls of housing member 13. Housing member 13 has an inner wall 14 disposed intermediate spaced opposite side walls 16 and 17 thereof with the opposite ends of rotatable bar 12 extending through the opposite spaced side walls of housing member 13 to receive the extremities of the outer side legs 11'' of spaced U-shaped brackets 11. The inner wall 14 of housing member 13 can be positionally mounted against the inner face of hinged door 3 so that the legend carried on legend face 9 of longitudinally extended handle 8 can be readily visible, the pivotally mounted handle 8 as disclosed extending advantageously in a horizontal position. It of course is to be understood that if so desired a suitable structural arrangement could be provided to pivotally mount the handle to extend vertically or in other selected positions.

In accordance with still another feature of the present invention, the aforedescribed opposite, spaced side walls 16 and 17 of housing member 13 are provided with a pair of locking bar slots 18 and 19 respectively. These slots are disposed in offset relation so that one slot of the pair can be aligned to be cooperable with door frame slot 4 on door frame 7 opposite the door frame hinge assembly 5 (which is located on the outer face of hinged door 3 and door frame 7'' as shown in FIG. 4). As will be described more fully hereinafter, the purpose of these offset slots 18 and 19 is to allow adjustment of the security lock assembly in accordance with the hinged location of the door 3 relative door frame 7 and the security lock receiving slot on the door frame side opposite the hinge.

Referring to FIGS. 1 and 2 of the drawings, disposed in wall and bracket mounted fashion on bracket mount 21' fastened to inner wall 14 within the housing member 13 is a numerical counter 21. Counter 21 can be any one of a number of types of counter mechanisms available on the commercial market. Advantageously, counter 21 includes a numerical set knob 22 at one end thereof and a moveable counter actuating arm 23 at the other end thereof to be connected to aperture 26 at one extremity of cam 24 and thus to preselectively and geometrically configured cam 24 pivotally mounted through a centrally located aperture 20 in cam 24 on inner wall 14 of housing member 13 in spaced relationship to such inner wall on cam mounting block 30 through an appropriate thrust bearing assembly, the block 30 being inserted into and fixed in slot 30' in inner wall 14.

In accordance with still another feature of the present invention and in keeping with the above description, cam 24 is contoured and configured so that it can cooperate with either of the two offset housing slots 18 or 19 which are disposed in the spaced opposite side walls 16 and 17 of housing member 13. Cam 24 is further provided with appropriate preselected apertures 27 and 27' positioned in spaced, substantially aligned relation above and below pivot aperture 20 and further includes hereinafter described resistance control aperture 35 and adjacent stop lip 28. Spaced aligned apertures 27 and 27' serve to selectively receive in fastened relation thereto the extremity of a reversible, longitudinally extending lock bar 34 of the mechanical control linkage—all in accordance with the hinged side of the door and the location of the door frame slot on the opposite side of the door frame. In still a further inventive feature of the present invention cam 24, as above discussed is provided with a right angle turned extremity 28 which serves as a stop lip member projecting outwardly toward the face panel cover for housing member 13.

As can be seen in FIG. 1 of the drawings, an adjustable spring loaded ball bearing carrying cylinder assembly 29 is fastened at one end to the inner face of inner wall 14 of housing member 13 to extend over aperture 29'. The spring loaded ball bearing at the other end of the cylinder assembly 29 engages with resistance control aperture 35—- so as to control the amount of force required to rotate cam 24. Mechanical linkage, broadly designated by reference numeral 31, connects the pivotally spaced, side-by-side upper bracket legs 11''' of U-shaped brackets 11 on which longitudinal handle 8 is mounted to the cam 24 and the cam 24 to the counter actuating arm 23. In still another feature of the present invention, mechanical linkage 31 includes an adjustable bar member 32 with its ends oppositely threaded to engage in spaced, opposed, cooperatively threaded eye bolts, one of which bolts 33 is mounted between the spaced inner side legs of spaced brackets 11 and the other of which bolts 33 is mounted to cam 24. This unique arrangement serves to allow adjustment of stroke length and to control the amount of force—-through the adjustable spring loaded ball bearing carrying cylinder 29 as abovedescribed—that is required to pivot the longitudinally extending handle 8 so as to actuate cam 24 and the numerical counter 21 connected thereto. Advantageously, the required force can be adjusted to comply with appropriate local and federal governmental regulations—usually in the fifteen (15) to twenty (20) pound range.

As can be seen in FIGS. 1 and 2, the longitudinally extending lock bar 34 is provided to lock the door with the slotted door frame side away from the hinge at one end thereof—slot 4 being engaged-disengaged, depending on the lock bar 34 connection to one of either spaced; aligned apertures 27 or 27' of cam 24. To appropriately guide lock bar 34 which is actuated at its other end through its connection to cam 24, at one of the two apertures 27 or 27', a longitudinally extending guide member 36 cantilevers from one of the two offset slots 18 and 19 in side walls 16 and 17—depending whether the door is left or right side hinge mounted—to encase and guide lock bar 34. At the distal end of guide member 36, spaced from that slot in housing member 13 through which lock bar 34 is to extend, a standard 37 is provided, this standard being fastened to the inner face of door 3.

As can be seen in FIG. 3, in order to render the housing 13 tamper proof, thus protecting the cam 24, mechanical linkage 31 force adjusting mechanism, and numerical counter 21, a facing wall panel cover 38 (FIG. 3) is provided for housing member 13. Wall panel cover 38 is appropriately sized and configured to be riveted to the extremities of opposed side walls 16 and 17 of housing member 13. Panel 38 includes a sight slot 39 to be aligned with the read out on numerical counter 21 encased in the housing to allow visual reading of the counter. Panel 38 further includes a key lock member 41 extending therethrough with a stop lip 42 fixed thereto to extend into the encased housing member 13 and engage with the stop lip 28 of cam 24, to thus arrest movement thereof when so engaged.

Finally, as can be seen in FIG. 4, a second locking bar assembly 43 is provided to engage with slot 6 on the door frame side 7 adjacent the hinge side of the door so as to prevent access through the door opening in the event of removal of the hinges 5 on the outer face of the door (only one hinge being shown at the breakaway). The mechanism is uniquely straightforward and simple to operate including a standard 44 fixed to the inner face of hinged door 3 adjacent the door hinge with a fixed locking bar 46 projecting normally therefrom in spaced parallel relation to the inner door face in alignment with slot 6 in door frame 7 so as to pivotally engage with slot 6 when the hinged door 3 is in closed position and disengage when door 3 is opened—the slot 6 being sized, contoured and aligned accordingly to permit this movement.

Figure 5:
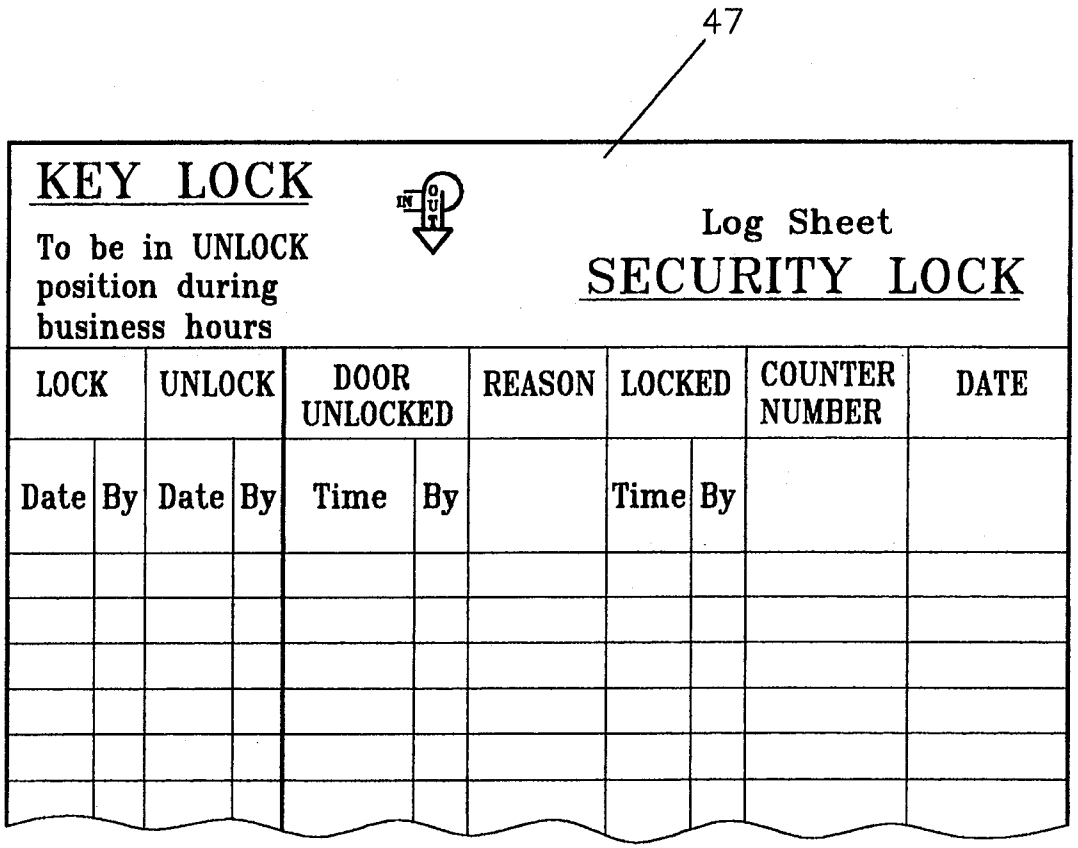

In order to control the opening and closing of the door by authorized personnel, a log memorandum 47 (FIG. 5) can be provided alongside the door 3 to allow recording of the time of opening, the name of the party opening, the counter number and the reason for such opening. In the event the counter number showing does not agree with log entries, an official will thus be alerted as to unauthorized usage.

The invention claimed is:

1. A security lock assembly for mounting on a door, said lock assembly being readily adaptable to be selectively positioned to cooperate with at least one slot associated with either one of two opposed sides of a door frame for said door with the other side of said door frame having a door hinge assembly for said door comprising:

a pivotal handle means adapted to be pivotally mounted on a face of said door;

reversible longitudinally extending locking bar means adapted and sized to be movably mounted for selective positioning on said door face of said door so as to be in aligned locking and unlocking relation with said selected slot associated with one of said two door frame sides;

mechanical linkage means adapted to be mounted to said door face to readily accommodate said reversible locking bar means in either selected position without change and to connect said pivotally mounted handle means with said reversible locking bar means when so selectively positioned whereby pivotal movement of said handle means actuates said mechanical linkage means to cause said locking bar means to engage and disengage in locking and unlocking relation with said one selected slot associated with either side of said door frame; and counter means cooperatively activated with said mechanical linkage means and said locking bar means movement to register the locking-unlocking, engagement-disengagement with either of said selected door frame side associated slot.

2. The security lock assembly of claim 1, said counter means being mounted on said face of said door in a tamper proof housing means.

3. The security lock assembly of claim 1, said door hinge assembly being mounted on one of two opposed faces of said door and said door frame, and a second locking means adapted to be fixed on said face of said door in aligned locking relation with a second slot on said door hinge assembly side of said door frame opposite said door frame side containing said one slot which cooperates with said movable locking bar means so as to prevent door movement upon door hinge removal.

4. The security lock assembly of claim 1, and stop means cooperative with said mechanical linkage means to arrest movement thereof.

5. The security lock assembly of claim 1, and adjustable spring loaded resistance means engageably cooperative with a resistance control aperture in said mechanical linkage means to adjust the force required to operate said security lock assembly.

6. The security lock assembly of claim 1, said pivotal handle means including a longitudinally extending handle bar having a cross-sectional contour to provide a longitudinally extending legend carrying face for printing readily visible to the eye.

7. The security lock assembly of claim 1, said mechanical linkage means including a pivotally mounted cam member adapted to be mounted to said door face with said locking bar means fastened at selected alternative spaced, aligned positions thereon, said cam member being contoured to be selectively connected with said locking bar means to selectively be cooperative with a slot which can be located in alternative positions on either side of a door frame.

8. The security lock assembly of claim 1, said locking bar means extending through a longitudinally extending guide member mounted to said door face.

9. The security lock assembly of claim 1, said mechanical linkage means including oppositely threaded adjustment bar means to adjust the amount of stroke length of said pivotal handle means.

10. The security lock assembly of claim 1 and a log memorandum associated with said assembly to allow the recording of time of opening, party opening, counter number and reason for opening.

11. The security lock assembly of claim 1, said mechanical linkage means and said counter means being encased in a tamper-proof housing having opposed side walls along with one end portion of said locking bar means with the opposite end portion of said locking bar means extending outside said tamper-proof housing.

12. The security lock assembly of claim 11, said tamper-proof housing including a pair of offset slots in opposite side walls thereof to selectively accommodate said locking bar means, said locking bar means being adaptable to be reversed to pass through one of said offset slots to be cooperable with a slot locatable on either side of a door frame.

13. The security lock assembly of claim 11, said tamper-proof housing including a facing wall panel adapted to be riveted to the said opposed side walls of said housing, said facing wall panel having a sight slot therein alignable with a readout on said counter means encased in said housing to allow visual reading of said readout on said counter means.

14. The security lock assembly of claim 13, said facing wall panel having a key lock member extending therethrough with stop means fixed thereto to extend into said housing, said stop means being cooperative with said mechanical linkage means to arrest movement thereof.

15. A security lock assembly for mounting on a door hinged by a hinge assembly to a door frame to cooperate with a pair of slots disposed in opposite sides of said door frame with one of said pair of slots being preselectively disposed adjacent the hinged side of said door and the other of said slot pair being located intermediate the opposite side of said door frame comprising: a longitudinally extending handle of preselected cross-sectional configuration to provide a longitudinally extending legend carrying face for printing, said handle being mounted on a pair of spaced side-by-side U-shaped bracket members, each of said bracket members including a base leg and two side legs with the base legs extending in end-to-end alignment and with one leg of each bracket extending adjacently to the other in spaced side-by-side relation and the other leg of each bracket serving as an outer side leg, said handle being fastened to said aligned base legs and the outer side legs of said brackets being fastened to the ends of a longitudinally extending rotatable support bar disposed in a housing mounted on an inner door face of said hinged door; said housing having a wall thereof including an inner and outer face intermediate a pair of connected opposite side walls, said intermediate wall being adapted to be fastened on said door face with said outer face of said intermediate wall facing said door face and with the opposite ends of said longitudinally extending rotatable support bar extending through said opposite side walls of said housing to fasteningly receive the extremities of said outer side legs of said pair of spaced side-by-side U-shaped bracket members, said intermediate wall of said housing fastened to said door face of said housing being positionally mounted against the door face of said housing so that the longitudinally extending legend carrying face for printing of said handle mounted on said aligned end-to-end base legs of said brackets will be readily visible, said opposite side walls connected to said intermediate wall of said housing having a pair of slots, each slot being disposed in offset relation to the other so that one slot of said pair of slots can be aligned to be cooperable with the door frame slot on a door frame side opposite said door frame hinge side; a numerical counter including a readout mounted within said housing, said counter having a rotatable numerical set knob at one end thereof and a movable counter actuating arm at the other end thereof; an actuating cam pivotally disposed about a central pivot point in said housing in spaced relation to said inner face of said housing, said cam being contoured and configured so that it can cooperate with either of said pair of Offset slots disposed in said opposite side walls of said housing, said cam being further provided with appropriate preselected apertures including a resistance control aperture and two spaced linkage apertures above and below said central pivot point to selectively receive mechanical control linkage therein in accordance with the location of said door frame slot on said door frame opposite said door frame hinge side, said cam having a stop member lip projecting outwardly therefrom away from said inner face of said intermediate wall; an adjustable spring loaded ball bearing cylinder fastened at one and to said inner face of said housing with a spring loaded ball bearing at the other end engaging as an adjustable spring loaded resistance member in said resistance control aperture in said cam to control the amount of force required to rotate said cam; mechanical linkage connecting said adjacently spaced side-by-side legs of said side-by-side brackets with said cam and said cam to said counter including an adjustably threaded bar assembly connectably extending between the spaced side-by-side inner legs of said brackets and said cam to control the amount of force required on said longitudinally extending legend carrying handle mounted to said aligned brackets to actuate said cam and linkage between said cam and said counter; a longitudinally extending lock bar having one end thereof fastened to said cam at one of two said spaced linkage apertures therein above and below said cam pivot point and extending longitudinally through said housing in engageable alignment with that offset slot of said offset pair of slots in said housing side walls aligned with said slot in said door frame opposite said hinge side for locking-unlocking engagement-disengagement therewith; a longitudinally extending guide member to encase a portion of said lock bar extending through one of said housing slots, said guide member being mounted on said door face at its distal end so as to be spaced from that slot in said opposite walls of said housing through which said lock bar extends and at its opposite proximal end in fastened relation to a side wall to be in surrounding relation with such slot through which said lock bar extends; a facing wall panel for said housing adapted to be riveted to the side walls of said housing in spaced parallel relation opposite said inner face of said intermediate wall mounted to said door frame, said facing wall panel having a sight slot therein alignable with said readout of said counter encased in said housing to allow visual reading of said counter and including a key lock member extending therethrough with a stop fixed thereto to extend into said housing to engage said stop member lip of said pivotal cam to arrest movement thereof; and, a second locking bar assembly including a locking bar and a standard adapted to be fixed on one of two opposed faces of said door adjacent said hinge assembly, said locking bar projecting from said standard in spaced parallel relation to said door face to pivotally engage and disengage with said slot in said door frame side adjacent said door hinge assembly.

* * * * *